US006967742B1

(12) United States Patent
Nagashima

(10) Patent No.: US 6,967,742 B1
(45) Date of Patent: Nov. 22, 2005

(54) PRINTER SERVER, METHOD FOR PROCESSING DATA AND STORAGE MEDIUM

(75) Inventor: Takeyuki Nagashima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/197,475

(22) Filed: Nov. 23, 1998

(30) Foreign Application Priority Data

Nov. 28, 1997 (JP) ..... 9/327466

(51) Int. Cl.[7] ..... B41B 2/00
(52) U.S. Cl. ..... 358/1.9; 358/406; 358/504
(58) Field of Search ..... 358/1.14, 1.15, 358/1.16, 1.9, 434, 468, 1.1, 1.12, 1.13, 504, 358/518, 406; 347/105

(56) References Cited

U.S. PATENT DOCUMENTS 5,581,376 A * 12/1996 Harrington ..... 358/518
5,854,882 A * 12/1998 Wang ..... 358/1.9
5,878,198 A 3/1999 Yuasa et al. ..... 395/117
5,907,669 A * 5/1999 Yoshiura et al.
6,137,594 A * 10/2000 Decker et al. ..... 358/1.9
6,141,120 A * 10/2000 Falk ..... 358/504
6,181,341 B1 * 1/2001 Shinagawa
6,188,807 B1 * 2/2001 Arakawa
6,226,097 B1 * 5/2001 Kimura

FOREIGN PATENT DOCUMENTS

JP 8-9158 1/1996

OTHER PUBLICATIONS

U.S. Appl. No. 08/916,928, filed Aug. 22, 1997.
U.S. Appl. No. 09/033,585, filed Mar. 3, 1998.
U.S. Appl. No. 09/084,122, filed May 26, 1998.

* cited by examiner

*Primary Examiner*—Mark Wallerson
(74) *Attorney, Agent, or Firm*—Fitzpatrick, Cella, Harper & Scinto

(57) ABSTRACT

For obtaining a print result of the image quality in which the color reproducibility is always stable even if receiving a printing job from any client computer, a first calibration control unit obtains correction data from a printer to store the data in a first memory, receives normal print information from a client computer, and corrects print data by referring to a correction table produced in accordance with the correction data when generating the print data based on the received print information.

13 Claims, 6 Drawing Sheets

FIG. 9

STORAGE MEDIUM SUCH AS FD/CD-ROM

| DIRECTORY INFORMATION |
| --- |
| 1ST DATA PROCESSING PROGRAM PROGRAM CODES CORRESPONDING TO STEP OF FLOW CHART IN FIG. 2 |
| 2ND DATA PROCESSING PROGRAM PROGRAM CODES CORRESPONDING TO STEP OF FLOW CHART IN FIG. 3 |
| 3RD DATA PROCESSING PROGRAM PROGRAM CODES CORRESPONDING TO STEP OF FLOW CHART IN FIG. 4 |
| 4TH DATA PROCESSING PROGRAM PROGRAM CODES CORRESPONDING TO STEP OF FLOW CHART IN FIG. 5 |
| 5TH DATA PROCESSING PROGRAM PROGRAM CODES CORRESPONDING TO STEP OF FLOW CHART IN FIG. 6 |
| 6TH DATA PROCESSING PROGRAM PROGRAM CODES CORRESPONDING TO STEP OF FLOW CHART IN FIG. 7 |
| |

MEMORY MAP OF STORAGE MEDIUM

PRINTER SERVER, METHOD FOR PROCESSING DATA AND STORAGE MEDIUM

BACKGROUND OF THE INVENTION

1. Field of the Invention

The present invention relates to a printer server for processing the print information supplied from a data processor through a predetermined communication medium and transferring print data to a printer, a method for processing the data in the printer server, and a storage medium storing a program which can be read by a computer.

2. Related Background Art

To correct the state change of a conventional printer such as the change of an output image due to the change of a condition such as temperature or humidity, or the state change or deterioration state of a visible image due to the deterioration of consumables such as a drum and toner cartridge in the case of an electrophotographic printer, calibration corresponding to the state change is performed so that the printer can output an image that meets requested density and color by correcting the print information received so as to be able to output the requested density and color even if the state change occurs.

In the case of a printing system for converting image data into binary notation with a client computer, correction data is obtained through the calibration of a printer by using the two-way-communication function of the client computer to produce a correction table and the image data is converted into binary notation by correcting the image data.

In the case of a shared printing system in which one printer is shared by a plurality of client computers, the above correction is asynchronously performed by the client computers.

To locally use a printer, it is possible to realize correction corresponding to the color reproducing characteristic of a printer by obtaining correction data through calibration and correcting image data as ever.

However, in the case of the shared printing system in which one printer is used on a network and shared by a plurality of client computers, the following problem occurs.

In the case of the above system, a printing job obtaining correction data is not always preferentially printed. When the printing job from a certain client computer is processed before the printing job of the other client computer is processed by a printer and lots of images are formed by the printer, the color reproducibility of the printer may be greatly changed due to the formation of the images.

That is, the correction data used for the correction provided with the print information corresponding to the printing job of a certain client computer may not correspond to the color reproducibility when the printing job is processed by a printer.

Thus, in the case of the shared printing system in which one printer is shared by a plurality of client computers, there is a problem that the correction corresponding to the color reproducibility when printing is executed cannot be performed by a conventional method.

Moreover, there is a problem that the application release time is prevented from being reduced while the processing and correction for producing a correction table are performed by a client computer in accordance with correction data.

SUMMARY OF THE INVENTION

The present invention is made to solve the above problems and its object is to make it possible to correct the image data supplied from a client computer correspondingly to the color reproducing characteristic of a printer and stably output high-quality data.

It is another object of the present invention to efficiently control the correction data corresponding to the color-reproducing characteristic of the printer in a system constituted with a client computer, a server computer, and an output device.

A preferable embodiment for achieving the above objects is a printer server for receiving a printing job from a terminal and transferring it to an output device, comprising:

recording means for storing the correction data corresponding to the output characteristic of the output device; and correction means for correcting the printing job in accordance with the correction data.

Objects other than the above objects and features of the present invention will become more apparent from the following detailed description of the embodiment of the present invention when taken in conjunction with the accompanying drawings.

BRIEF DESCRIPTION OF THE DRAWINGS

FIG. 9 is an illustration for explaining a memory map of a storage medium for storing various types of data-processing programs which can be read by a printing system to which a printer server of the present invention can be applied.

DETAILED DESCRIPTION OF THE PREFERRED EMBODIMENTS

The preferred embodiments of the present invention are described below by referring to the accompanying drawings.

Figure 1:
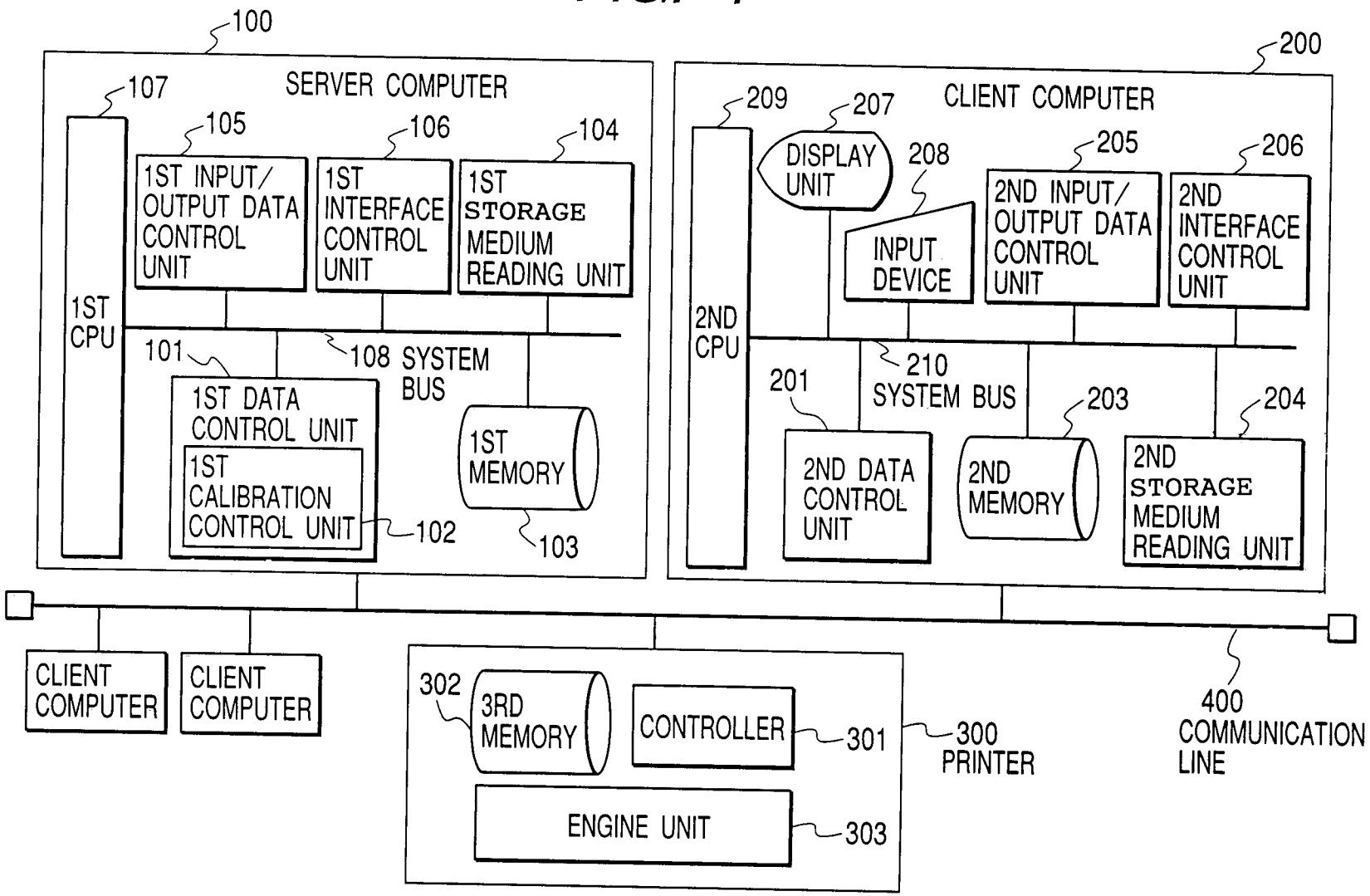
FIG. 1 is a block diagram for explaining the structure of a printing system to which a printer server of an embodiment of the present invention can be applied.

FIG. 1 is a block diagram for explaining the structure of a printing system to which the printer server of an embodiment of the present invention can be applied. The printing system is constituted with a server computer (printer server)

having the two-way function, a client computer, and a printer. In the case of the printing system using this embodiment, a printer server is set between a plurality of client computers on one hand and a printer on the other. Moreover, the printer server controls the printing job supplied from each client in uniformed or distributed manner, and calibration.

In FIG. 1, the printing system is constituted with a server computer 100, a client computer 200, a printer 300, and a communication line 400 for connecting them.

The server computer 100 is provided with a first data control unit 101, a first calibration control unit 102, a first memory 103, a first recording-medium reading unit 104, a first input/output data control unit 105, a first interface control unit 106, a first CPU 107 for controlling every operation of the server computer 100, and a system bus 108 for connecting them. In this case, the first data control unit 101 has the function of a so-called language monitor connected with the printer in two-way manner to obtain correction data or a function equivalent to that of the monitor and moreover, has the so-called printer-server function for controlling a plurality of printing jobs. Moreover, the first data control unit 101 stores the print data received from the client computer 100 in a medium to be read by the first memory 103 or first recording-medium reading unit 104 and controls the processing for transmitting the print data to the printer 300 in accordance with printing-job control.

Moreover, the first recording-medium reading unit 104 and a second recording-medium reading unit 204 to be described later can read programs and image data from a storage medium such as an FD (floppy disk), CD-ROM, ROM, or magnetic tape of a language monitor or a printer driver.

The client computer 200 is provided with a second data control unit 201, a second memory 203, a second recording-medium reading unit 204, a second input/output data control unit 205, a second interface control unit 206, a display unit 207, an input device 208, a second CPU 209 for controlling every operation of the client computer 200, and a system bus 210 for connecting them.

The display unit 207 is a display device such as a CRT display or liquid-crystal display. The input device 208 is a pointing device such as a keyboard or mouse.

In this case, the second data control unit 201 is a so-called printer driver. The printer driver is a program for processing print data generated through an application in accordance with a printer between an operating system resident on the client computer 200 and the printer 300 and controls the printer 300 and the program is stored in the second memory 203 or a medium to be read by the second recording-medium reading unit 204. The communication line 400 is a two-way serial interface such as a normal LAN, IEEE1394, or USB.

The printer 300 is provided with a controller 301, a third memory 302 controlled by the controller 301 and an engine unit 303.

The engine unit 303 particularly has a function capable of properly communicating a calibration request to the controller in addition to the normal engine-processing function.

The controller 301 has a function for executing the calibration processing when calibration is requested by the engine unit, obtaining correction data, storing the data in a third memory 302 in addition to the normal controller-processing function.

Moreover, the engine unit 303 issues a calibration request to the controller 301 when one of various state parameters showing the states of the unit 303 reaches a predetermined value. In the case of an electrophotographic engine, the state parameters include the operation frequency of a photosensitive drum after replaced, the temperature and humidity in a printer, and the temperature of a fixing unit for melting toner in the printer.

Furthermore, in the case of an ink jet system for heating ink with a heater to cause film boiling and discharging the ink by the pressure, the temperature of the ink and the temperature of a heater for heating the ink serve as state parameters.

Furthermore, the engine unit 303 monitors these parameters with various sensors or counters. Furthermore, the unit 303 has a density sensor for directly detecting the toner density on a drum. Therefore, the unit 303 can also be used for calibration by directly detecting the density of an image.

[Structure of Printer]

An example of the structure of the electrophotographic printer 300 is described below.

The print data received from a server computer is image-processed by the controller 301 and input to the engine unit 303 in which image formation processing is performed.

The controller 301 performs the processing for developing the print data shown by PDL (Page Description Language) already corrected into luster image data.

The engine unit 303 forms an electrostatic latent image by scanning a photosensitive drum with a laser beam modulated in accordance with the luster image data for each developed color (C, M, Y, or K) by a polygon mirror.

Then, the unit 303 obtains a visible image by toner-developing the electrostatic latent image and multiple-transfers the visible image to an intermediate transfer body on all colors to form a colored visible image. Moreover, the unit 303 transfers the colored visible image to a transfer material to fix the colored visible image on the transfer material. An image formation unit for performing the above control is constituted with a drum unit having a photosensitive drum, a primary electrification unit having a contact electrification roller, a cleaning unit, a development unit, an intermediate transfer body, a form-feed unit including a form cassette and various rollers, a transfer unit including a transfer roller, and a fixing unit.

In this case, the drum unit is constituted by integrating a photosensitive drum (photosensitive body) with a cleaner vessel having a cleaning function and also serving as the holder of the photosensitive drum. The drum unit is removably supported to the printer body and constituted so that the unit can be easily replaced in accordance with the service life of the photosensitive drum. The photosensitive drum is constituted by applying an organic photoconductor layer on the outer periphery of an aluminum cylinder and rotatably supported to the cleaner vessel. The photosensitive drum is rotated by the driving force transferred from a driving motor and the driving motor rotates the photosensitive drum counterclockwise in accordance with the image forming operation. The photosensitive drum is constituted so that an electrostatic latent image is formed by selectively exposing the surface of the photosensitive drum with a laser beam supplied from a scanner unit. In the case of the scanner unit, a modulated laser beam is reflected by a polygon mirror rotated by a motor synchronously with a horizontal-synchronizing signal for an image signal to irradiate the photosensitive drum through a lens and a reflector.

The development unit has three color development counters for performing development of yellow (Y), magenta (M), and cyan (C) and a black development counter for performing the development of black (K) in order to change the electrostatic latent image to a visible image. The color development counter and the black development counter are respectively provided with sleeves and a coating blade pressure-welded to the outer periphery of each sleeve. Moreover, three color development counters are respectively provided with a coating roller.

Furthermore, the black development counter is removably set to the printer body and each color development is removably set to a development rotary about a rotation axis.

The sleeves of the black development counter are respectively arranged with a very small interval of, for example, approximately 300 μm separate from the photosensitive drum. The black development counter carries toner with a feed member built in the counter and supplies electric charges to toner through frictional electrification so as to apply toner to the outer periphery of each sleeve rotating clockwise with a coating blade. Moreover, by applying a bias to the sleeves, the photosensitive drum is developed correspondingly to an electrostatic latent image to form a visible image of black toner on the photosensitive drum.

Three color development counters rotate in accordance with the rotation of the development rotary to form an image and a predetermined sleeve faces the photosensitive drum at a very small interval of approximately 300 μm from the photosensitive drum. Thereby, a predetermined color development counter stops at a development position facing the photosensitive drum and a visible image is formed on the photosensitive drum.

To form a color image, the development rotary rotates for each turn of the intermediate transfer body and the development process is executed in order of yellow development counter, magenta development counter, cyan development counter, and black development counter, the intermediate transfer body rotates four turns to successively form visible images of yellow, magenta, cyan, and black toners, resulting in full colored visible images on the intermediate transfer body.

The intermediate transfer body is constituted so as to rotate in accordance with the rotation of the photosensitive drum by contacting the photosensitive drum, which rotates clockwise when a color image is formed and receives the multiple transfer of four-turn visible image from the photosensitive drum. Moreover, the intermediate transfer body simultaneously multiple-transfers a colored visible image on the intermediate transfer material to a transfer material because a transfer roller to be described later contacts the intermediate transfer body when the image is formed to hold and carry the transfer body. A TOP sensor and an RS sensor for detecting a position related to the rotational direction of the intermediate transfer body and a density sensor for detecting the density of a toner image transferred to the intermediate transfer body are arranged on the outer periphery of the intermediate transfer body. The transfer roller separates downward so as not to disturb a colored visible image while multiple-transferring the colored visible image onto the intermediate transfer body. Moreover, after four colored visible images are formed on the intermediate transfer body, the transfer roller is moved upward with a cam member in accordance with the timing for transferring the colored visible images to the transfer material. Thereby, the transfer roller is pressure-welded to the intermediate transfer body at a predetermined pressure through the transfer material, a bias voltage is applied, and the colored visible images on the intermediate transfer body are transferred to the transfer material. The fixing unit fixes the transferred colored visible images while carrying the transfer material, which is provided with a fixing roller for heating the transfer material and a pressure roller for pressure-welding the transfer material to the fixing roller. The fixing roller and the pressure roller are formed into hollow bodies and a heater is built in the rollers. That is, the transfer material holding colored visible images are carried by the fixing roller and the pressure roller and toner is fixed to the surface of the rollers by adding heat and pressure. The transfer material in which the visible images are fixed is thereafter ejected to a paper ejection unit by a paper ejection roller and the image forming operation is completed.

Cleaning means cleans the toner left on the photosensitive drum and the intermediate transfer body and the waste toner after transferring a visible image of toner formed on the photosensitive drum to the intermediate transfer body or the waste toner after transferring the four colored visible images formed on the intermediate transfer body to the transfer material is stored in the cleaner vessel.

Figure 2:
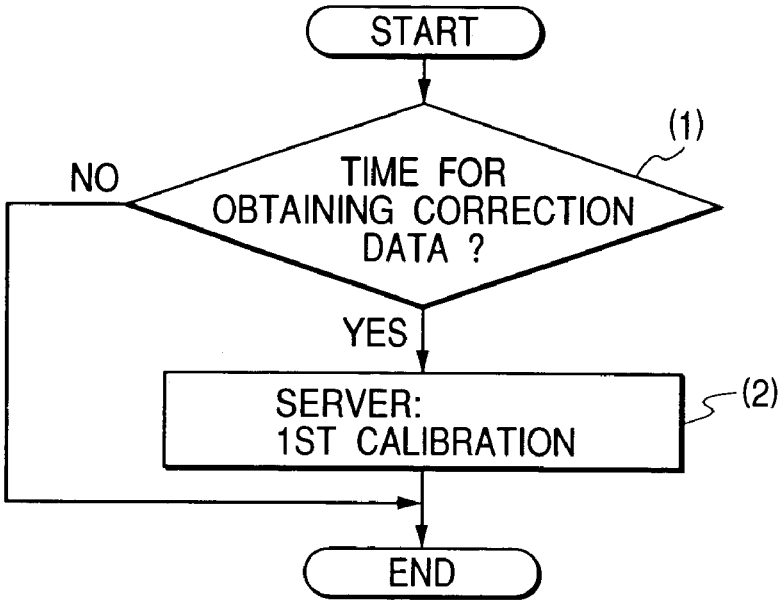
FIG. 2 is a flowchart showing an example of the data-processing procedure by the printing system using the embodiment in FIG. 1.
Figure 3:
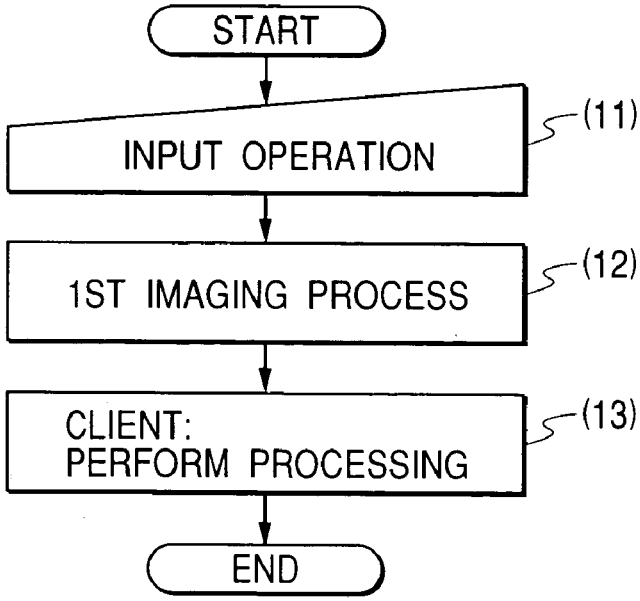
FIG. 3 is a flowchart showing an example of the data-processing procedure by the printing system using the embodiment in FIG. 1.
Figure 4:
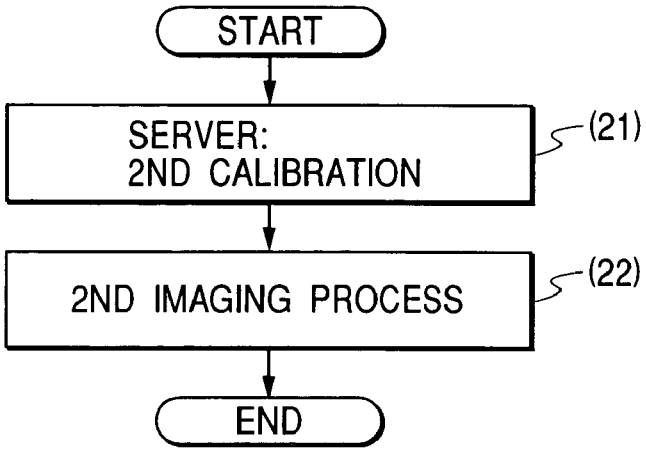
FIG. 4 is a flowchart showing an example of the data-processing procedure by the printing system using the embodiment in FIG. 1.

FIGS. 2 to 7 are flowcharts showing an example of the data-processing procedure by a printing system using an embodiment, FIGS. 2 and 4 correspond to the data correction control procedure by the first calibration control unit 102, and FIG. 3 corresponds to the data correction control procedure by the second control unit 201. Numbers (1), (2), (11) to (13), (21), and (22) respectively show each step.

Figure 5:
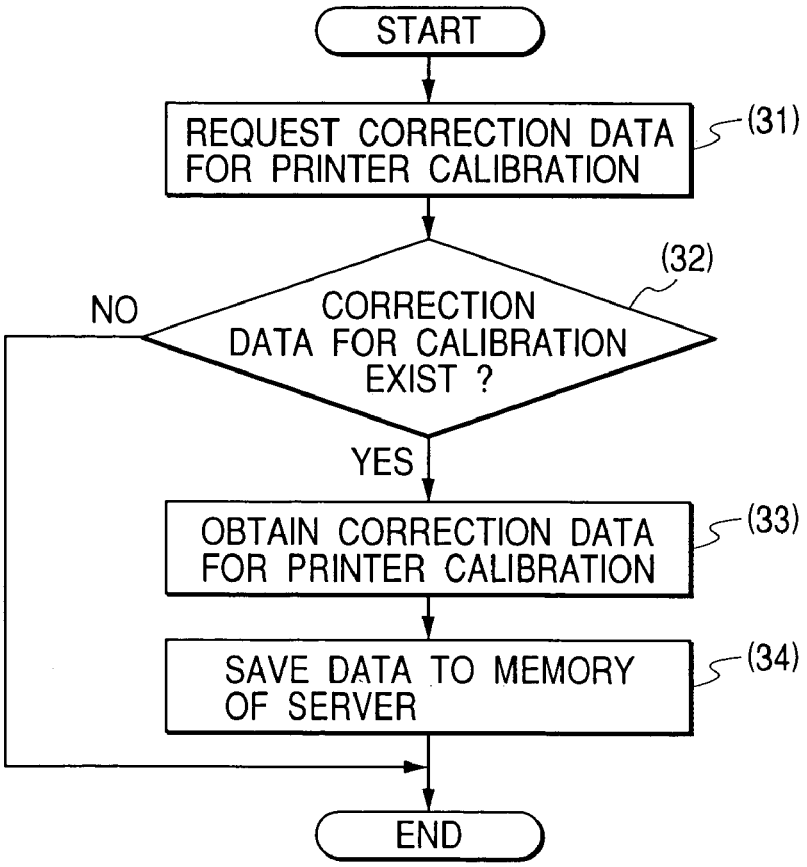
FIG. 5 is a flowchart showing an example of the data-processing procedure by the printing system using the embodiment in FIG. 1.

Moreover, FIG. 5 is a flowchart showing the detailed procedure of the first calibration shown in FIG. 2 and numbers (31) to (34) respectively show each step.

The first calibration includes the printer correction data requesting step (31), printer correction data presence deciding step (32), printer control correction data obtaining step (33), and server control correction data storing step (34).

Figure 6:
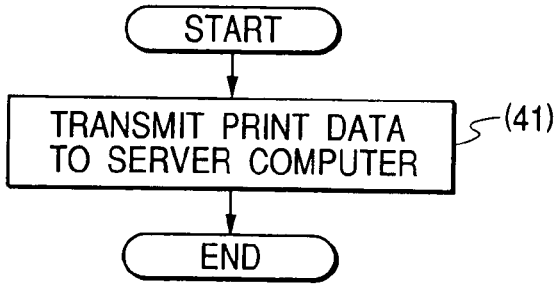
FIG. 6 is a flowchart showing an example of the data-processing procedure by the printing system using the embodiment in FIG. 1.

Moreover, FIG. 6 corresponds to the detailed procedure in the processing step (13) at the client side shown in FIG. 3, which includes the before-correction print data transfer accessing step (41).

Figure 7:
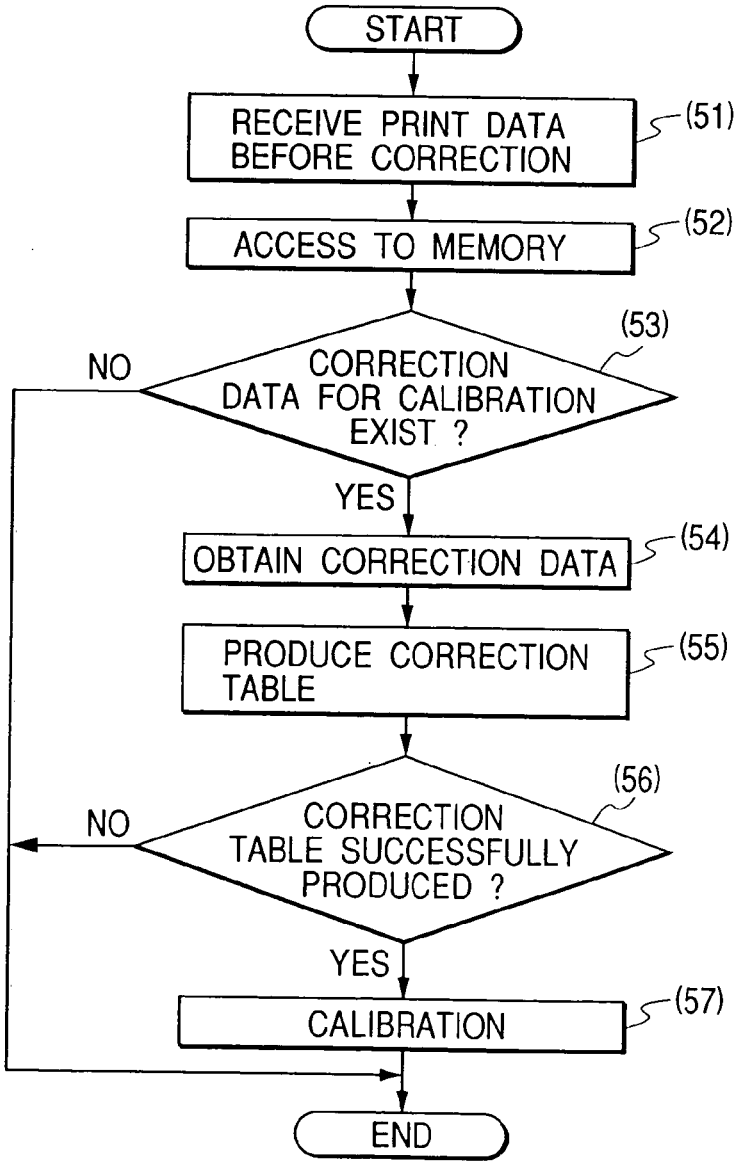
FIG. 7 is a flowchart showing an example of the data-processing procedure by the printing system using the embodiment in FIG. 1.

Furthermore, FIG. 7 corresponds to the detailed procedure at the server computer side shown in FIG. 4, which includes the before-correction print data receiving step (51), correction-data-obtaining memory accessing step (52), server control correction data presence deciding step (53), server control correction data obtaining step (54), correction table production deciding step (55), correction table production deciding step (56), and calibration executing step (57).

The data correcting operation by this embodiment constituted as described above is described below by referring to FIGS. 2 to 7.

The processing for the server computer 100 to obtain correction data in accordance with the control by the first calibration control unit 102 is described below by referring to FIGS. 2 and 5.

It is decided whether the present is the timing for obtaining correction data (1) and the decision results in "YES". Thereby, the first calibration at the server side (shown in FIG. 5) is executed (2).

The timing for obtaining correction data can be executed asynchronously or synchronously with the second data control unit 201 of a client computer.

For example, for the timing to be executed asynchronously with the unit 201, there is a method of using a certain elapsed time as the obtaining timing by using a system clock or the like. In this case, it is possible to improve the accuracy by shortening an elapsed time to be set. Moreover, for the timing to be executed synchronously with the unit 201, there is a method of using the time when print data is transmitted from a client computer as the obtaining timing.

The first calibration control unit 102 requests correction data for the controller 301 of the printer 300 {step (31)} to decide whether correction data is present in the third memory 302 {step (32)}. Step (32) compares, for example, the calibration execution date which is the additional information for the correction date previously stored in the first memory 103 with the calibration execution date which is the additional information for the correction data stored in the third memory 302 to decide whether the correction data stored in the first memory 103 is the latest correction data. Then, when the correction data is the latest data, step (32) completes the first calibration of a server. Thus, by completing the first calibration in accordance with the decision result by step (32), it is possible to prevent steps (33) and (34) from being unnecessarily executed and improve the processing efficiency.

Correction data is the data generated through the calibration performed by the engine unit 303, which is the data for correcting the change of color reproducibilities of the engine unit 303 produced due to change with time or environmental change.

Calibration is started when the engine unit 303 of the printer 300 issues a calibration request to the controller 301 and the controller 301 returns a calibration execution command to the engine unit 303 correspondingly to the request and executed in accordance with the control by the controller 301.

As disclosed in Japanese Patent Application No. 7-92385 laid open as Japanese Patent Application Laid-Open No. 8-9158, of the present applicant, calibration is constituted with two types of processing such as Dmax control for controlling the process of the engine unit 303 and the processing for obtaining correction data by measuring the gradation batch generated by an engine for which the Dmax control is performed every recording agent.

Correction data is the data generated for each recording agent and the data showing the relation between input density and actually-formed output density. Correction data is described below by referring to FIG. 8.

Figure 8:
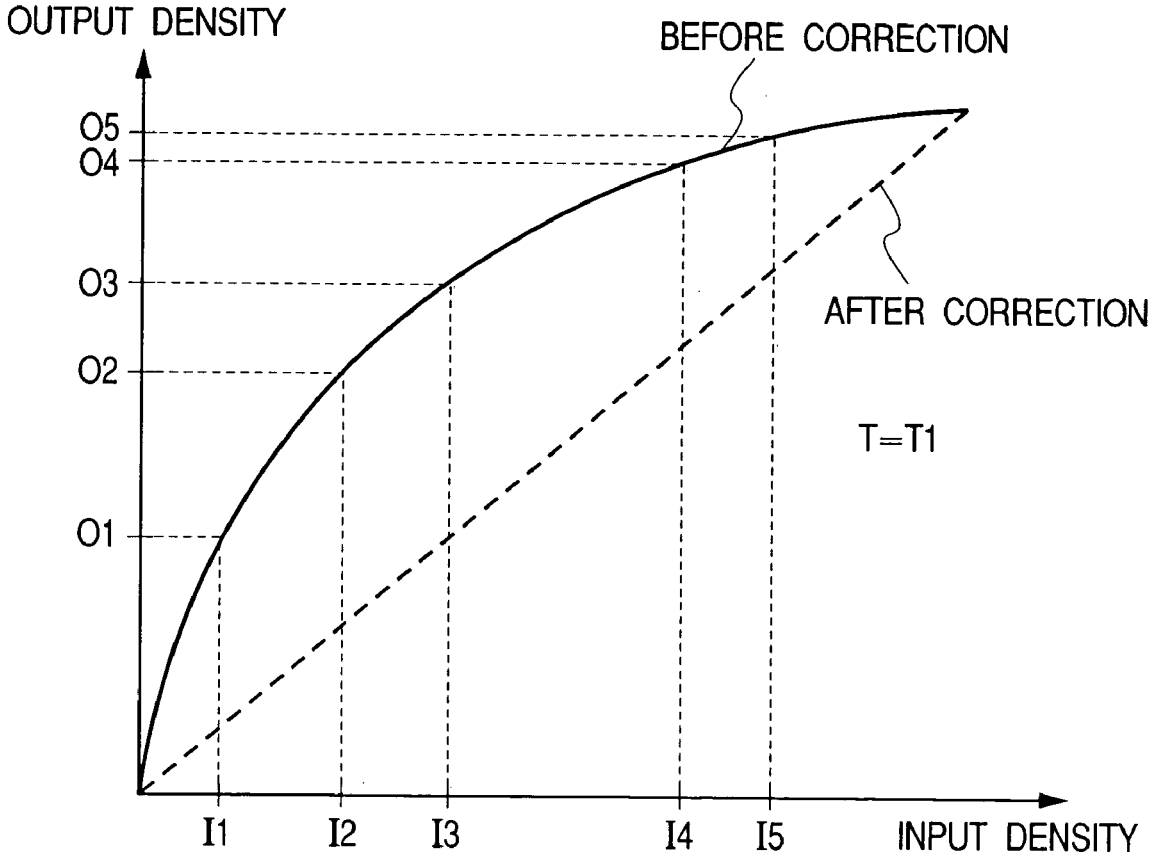
FIG. 8 is an illustration showing an example of the correction data corresponding to a certain recording agent.

FIG. 8 is an illustration showing an example of correction data corresponding to a certain recording agent, in which y-axis shows output density obtained by measuring generated gradation batch and x-axis shows input density input to an engine unit in order to generate gradation batch.

In the case of the color reproducing characteristic of the engine unit 303, it is ideally preferable that input density and output density are matched as shown by the broken line. However, when the above-mentioned state parameter reaches a threshold, the color reproducing characteristic of the engine unit 303 is deviated from the ideal line as shown by the continuous line. Therefore, the color reproducing characteristic shown by the continuous line deviated from the ideal line is recorded by correction data. For example, the information showing a calibration date is added to output densities O1 to O5 to predetermined input densities I1 to I5 as correction data and used.

When it is decided in step (32) shown in FIG. 5 that correction data is present, correction data is obtained from the third memory 302 through communication between the controller 301 and the first calibration control unit 102 of the first data control unit 101 {step (33)}. Then, the obtained correction data is stored in the first memory 103 of the server computer 100 {step (34)}.

Printing performed in accordance with a printing job is described below by referring to FIGS. 3, 4, and 6.

In FIG. 3, when the input operation for executing printing is performed for an application or printer driver by an operator through the input device 208 and display unit 207 in the client computer 200 {step (11)}, the following processing is performed asynchronously with the processing in the server computer 100.

Normal first image processing is applied to print data (12). Moreover, the first image processing converts RGB (8 bits) data into CMYK (8 bits) data when processing, for example, print data as color data with the print data control unit 201.

As the first image processing, for example, color matching using an input device on which print data depends and the printer 300 as an output device, brightness-density conversion for converting the RGB data to which the color matching is applied into the CMYK data, and masking UCR processing are performed.

Moreover, as shown in FIG. 6, the print data before correction to which conversion into the CMYK (8 bits) data is applied is transferred to the server computer 200 {step (41)}.

For the above step (41), the processing shown in FIG. 4 is performed in the server computer 200. The processing shown in FIG. 7 is performed as the second calibration {step (21)}.

First, the print data before correction is received {step (51)}. Then, the first memory 103 in which correction data is stored in step (2) in FIG. 2 is accessed {step (52)}, it is decided whether the correction data for performing calibration is present {step (53)}, and the decision results in "YES". Then, correction data is read out of the storage region of the first memory 103 {step (54)} and a correction table is produced {step (55)}.

In this case, the correction table is a table for correcting the relation between input and output densities before correction shown by the continuous line to the ideal relation shown by the broken line in the case of the example shown in FIG. 8.

In step (55), a correction curve is generated by estimating the curve shown by the continuous line in FIG. 8 showing the color reproducing characteristic of a changed engine unit in accordance with the stored correction data and converting the curve so that the curve becomes line-symmetric to the ideal line shown by the broken line. One-dimensional LUT is generated in accordance with the correction curve. Then, the one-dimensional LUT generation is performed for each recording agent.

Then, it is decided whether a correction table is produced in step (55) (56). The decision results in "YES" and the CMYK (8 bits) data received by using the produced correction table is corrected {step (57)}.

Then, the second image processing is applied to print data {step (22)}. Moreover, the second image processing includes the binary-notation processing and output processing to be performed for the corrected CMYK (8 bits) data.

Moreover, it is needless to say that the first calibration control unit 102 of the server computer 100 shown in FIG. 1 can apply proper correction then requested by a printer to print data by not correcting the print data before correction received from the client computer 200 in reentrant manner or by obtaining the correction data from a printer after processing a printing job at the timing for obtaining the correction data from the printer.

The above procedure makes it possible to form a high-quality output image in the server computer 100 having a two-way function for the calibration request from the printer 300. That is, it is possible to form and output a high-quality image independently of the state of the printer 300.

Moreover, according to this embodiment, it is unnecessary to control calibration data with each client computer because the calibration data of a printer is controlled with a server computer.

Therefore, it is possible to efficiently control the calibration data in a network in which the same printer can be used by a plurality of clients.

[Modification]

In the case of the above embodiment, the output densities O1 to O5 to the predetermined input densities I1 to I5 shown in FIG. 8 are stored in the third memory 302 as correction data.

A modification previously obtains the relation between input and output densities for the change of each state parameter through experiments and stores the relation in the third memory 302.

For example, by making fixing temperature correspond to temperature T, the relation between input and output densities is obtained. Then, in the case of calibration, a controller requests the value of each state parameter for an engine unit in accordance with a calibration request, synthesizes the relation between input and output densities corresponding to each obtained state-parameter value, and obtains the correction data at the present point of time.

This modification makes it possible to shorten the time required for calibration because it is unnecessary to form gradation batch because correction data is generated.

Moreover, in the case of the above embodiment, RGB data is converted into CMYK data through the first image processing {step (12)} by a client computer and calibration {step (57)} is applied to each color by a server computer by using one-dimensional LUT corresponding to the color reproducing characteristic of an engine unit. Moreover, as a modification, it is possible to add conversion data used for the first image processing to image data and transmit the data to a server computer so that the server computer synthesizes the added conversion data and one-dimensional LUT to produce one conversion data value (such as RGB-to-CMYK multi-dimensional LUT) to correct the image data. This modification makes it possible to perform the first image processing {step (12)} and the calibration {step (57)} at the same time. Therefore, it is possible to efficiently constitute a system.

Moreover, in the case of the above embodiment, only one printer can be connected to a server computer as shown in FIG. 1. However, it is also possible to form a structure in which a plurality of printers can be connected to one server computer. In this case, it is necessary to provide a first control unit corresponding to each model name for a server and control calibration data for each unit.

Furthermore, it is possible to automatically transmit the correction-data obtaining timing from a printer to a server computer at the timing when calibration of the printer is completed. Thus, it is possible for the server computer to always prepare the latest calibration data by communicating with the printer only when the power supply is turned on.

Furthermore, for the above embodiment, a printing system is described as an example in which the printer 300 is directly connected to the network shown in FIG. 1 and the server computer 100 is operated as the computer for controlling a printing job for the printer 300. However, it is also possible to apply the printer 300 to various computer systems by locally connecting with a certain client computer (practically, the client computer serves as a server computer) instead of directly connecting with a network or locally connecting with a certain server computer instead of directly connecting with a network.

Furthermore, it is possible to apply the printer 300 to a printing system (system for processing the entire print data with a server computer) for executing the first image processing shown in FIG. 3 before step (21) shown in FIG. 4.

Furthermore, it is possible to store the steps shown in FIGS. 2 to 7 in a storage medium such as an FD (floppy disk), CD-ROM, ROM, or magnetic tape and in the recording-medium reading units of the server computer 100 and client computer 200.

Furthermore, it is possible to apply the present invention to a system constituted with a plurality of units or an apparatus constituted with one unit. Furthermore, it is needless to say that the present invention can be applied to a case in which the present invention is executed by supplying a program to a system or an apparatus.

In this case, a storage medium storing a program related to the present invention constitutes the present invention. Moreover, by reading the program from the storage medium into a system or apparatus, the system or apparatus is operated in accordance with a predetermined method.

Furthermore, the correction table described for this embodiment, specifically described in step (55) shown in FIG. 7 can be produced by the controller 301 of the printer 300 and stored in the third memory 302.

In this case, the first calibration control unit 102 of the server computer 100 does not obtain correction data but a correction table from the printer 300 and controls the table. Moreover, the data {step (54)} obtained by the client computer 200 is not correction data but a correction table.

The structure of a data-processing program which can be read by a printing system to which a printer server of the present invention can be applied is described below by referring to the memory map shown in FIG. 9.

FIG. 9 is an illustration for explaining the memory map of a storage medium for storing various data-processing programs which can be read by a printing system to which a printer server of the present invention can be applied.

Though not illustrated, the information for controlling program groups stored in a storage medium such as version information or a producer is also stored and moreover, the information depending on the OS at the program reading side such as an icon for identifying and displaying a program may be stored.

Moreover, the data subordinate to various programs is also controlled in accordance with the above directory. Furthermore, a program for installing various programs in a computer or a program for decompressing a program to be installed when it is compressed may be stored.

The functions of this embodiment shown in FIGS. 2 to 7 can be executed by a host computer in accordance with an externally-installed program. Moreover, the present invention can be applied to a case in which an information group including a program is supplied to an output device from a storage medium such as a CD-ROM, flash memory, or FD or from an external storage medium through a network.

As described above, it is needless to say that the object of the present invention can also be achieved by supplying a storage medium storing the program code of the software for realizing the functions of the above embodiment to a system or an apparatus and reading the program code stored in the storage medium by the system or apparatus (or CPU or MPU).

In this case, the program code read out of the storage medium realizes the novel function of the present invention and the storage medium storing the program code constitutes the present invention.

A storage medium for supplying a program code can use a floppy disk, hard disk, optical disk, optical-magnetic disk, CD-ROM, CD-R, magnetic tape, nonvolatile memory card, ROM, or EEPROM.

Moreover, it is needless to say that, by executing a program code read by a computer, cases are included in which not only the functions of the above embodiment are realized but also the OS (Operating System) working on the computer or the like performs a part or the whole of actual processing in accordance with the designation of the program code, and the functions of the above embodiment are realized by the processing.

Furthermore, it is needless to say that a case is included in which a program code read out of a storage medium is written in a memory provided for a function extension board inserted into a computer or a function extension unit connected to the computer and thereafter, the CPU or the like provided for the function extension board or function extension unit performs a part or the whole of actual processing in accordance with the designation by the program code, and the functions of the above embodiment are realized by the processing.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image processing method which is executed by a server computer capable of being connected to an image forming unit, which has a calibration function to obtain correction data by forming and measuring a patch, and to plural client computers, said method comprising:

an obtaining step of obtaining the correction data by communicating with the image forming unit, wherein said correction data is automatically obtained from the image forming unit, which executes the calibration function in the image forming unit to obtain the correction data;

a receiving step of receiving a color-matched printing job from the client computer;

a correcting step of performing, using the correction data obtained from the image forming unit, a correction process on image data included in the printing job received from the client computer; and an outputting step of outputting the image data corrected in said correcting step to the image forming unit, wherein color-matching image processing is performed by the client computer.

2. A method according to claim 1, wherein said obtaining step is repeated within a predetermined time interval to obtain the correction data from the image forming unit.

3. A method according to claim 1, wherein the image forming unit automatically executes the calibration function according to a condition of state parameters of the image forming unit.

4. A method according to claim 1, further comprising the step of judging whether or not the correction data should be updated, by comparing additional information of the latest correction data obtained by communicating with the image forming unit with additional information of the correction data already stored.

5. A computer-readable storage medium which stores a program to achieve an image processing method which is executed by a server computer capable of being connected to an image forming unit, which has a calibration function to obtain correction data by forming and measuring a patch, and to plural client computers, said method comprising:

an obtaining step of obtaining the correction data by communicating with the image forming unit, wherein said correction data is automatically obtained from the image forming unit, which executes the calibration function in the image forming unit to obtain the correction data;

a receiving step of receiving a color-matched printing job from the client computer;

a correcting step of performing, using the correction data obtained from the image forming unit, a correction process on image data included in the printing job received from the client computer; and an outputting step of outputting the image data corrected in said correcting step to the image forming unit, wherein color-matching image processing is performed by the client computer.

6. A storage medium according to claim 5, wherein said obtaining step is repeated within a predetermined time interval to obtain the correction data from the image forming unit.

7. A storage medium according to claim 5, wherein the image forming unit automatically executes the calibration function according to a condition of state parameters of the image forming unit.

8. A storage medium according to claim 5, further comprising the step of judging whether or not the correction data should be updated, by comparing additional information of the latest correction data obtained by communicating with the image forming unit with additional information of the correction data already stored.

9. A computer-readable program to achieve an image processing method which is executed by a server computer capable of being connected to an image forming unit, which has a calibration function to obtain correction data by forming and measuring a patch, and to plural client computers, said program comprising:

an obtaining module that obtains the correction data by communicating with the image forming unit, wherein said correction data is automatically obtained from the image forming unit, which executes the calibration function in the image forming unit to obtain the correction data;

a receiving module that receives a color-matched printing job from the client computer;

a correcting module that performs, using the correction data obtained from the image forming unit, a correction process on image data included in the printing job received from the client computer; and an outputting module that outputs the image data corrected by said correcting module to the image forming unit, wherein color-matching image processing is performed by the client computer.

10. A computer-readable program according to claim 9, wherein said obtaining step is repeated within a pre-determined time interval to obtain the correction data from the image forming unit.

11. A computer-readable program according to claim 9, wherein the image forming unit automatically executes the calibration function according to a condition of state parameters of the image forming unit.

12. A computer-readable program according to claim 9, wherein said program further comprises the step of judging whether or not the correction data should be updated, by comparing additional information of the latest correction data obtained by communicating with the image forming unit with additional information of the correction data already stored.

13. An image processing method which is executed in a server computer capable of being connected to an image forming unit, which has a calibration function to obtain correction data by forming and measuring a patch, and to plural client computers, said method comprising:

an obtaining step of automatically obtaining from the image forming unit the correction data by communicating with the image forming unit, wherein the calibration function is executed in the image forming unit to obtain the correction data;

a receiving step of receiving a printing job from the client computer;

a correcting step of performing, using conversion data used in color matching for the image forming unit, a color matching process to the image data included in the printing job received from the client computer, and performing a correction process using the correction data obtained from the image forming unit; and an outputting step of outputting the image data corrected in said correcting step to the image forming unit.

* * * * *

UNITED STATES PATENT AND TRADEMARK OFFICE

CERTIFICATE OF CORRECTION

PATENT NO. : 6,967,742 B1
APPLICATION NO. : 09/197475
DATED : November 22, 2005
INVENTOR(S) : Takeyuki Nagashima It is certified that error appears in the above-identified patent and that said Letters Patent is hereby corrected as shown below:

Title Page:

(30) Foreign Application Priority Data, "9/327466" should read -- 9-327466 --; and

(56) References Cited, U.S. PATENT DOCUMENTS:

| | | | |
|---|---|---|---|
| -- 6,046,820 | 04-2000 | Konishi, Jun | 358/1.9 |
| 6,219,151 | 04-2001 | Manglapus et al. | 358/1.15 |
| 6,160,968 | 12-2000 | Noda, Akihiko | 399/8 |
| 5,313,291 | 05-1994 | Appel et al. | 358/501 |
| 5,734,407 | 03-1998 | Yamada et al. | 347/133 |
| 6,280,105 | 08-2001 | Iida, Mitsunori | 400/74 |
| 5,710,871 | 01-1998 | Tadenuma et al. | 358/1.9 |
| 5,933,676 | 08-1999 | Ohno, Takashi | 399/8 |
| 5,950,036 | 09-1999 | Konishi, Jun | 399/8 |
| 6,256,111 | 07-2001 | Rijavec, Nenad | 358/1.9 |
| 6,172,771 | 01-2001 | Ikeda et al. | 358/406 |
| 6,188,486 | 02-2001 | Yamada | 358/1.15 |
| 6,219,148 | 04-2001 | Takashima | 358/1/15 |
| 6,222,635 | 04-2001 | Gotoh | 358/1.15 |
| 5,845,076 | 12-1998 | Arkawa | 395/200.33 |
| 5,625,757 | 04-1997 | Kageyama et al. | 395/113 -- |

should be inserted.

Signed and Sealed this

Fifteenth Day of May, 2007

JON W. DUDAS
*Director of the United States Patent and Trademark Office*